US010161198B2

(12) United States Patent
Kiess et al.

(10) Patent No.: US 10,161,198 B2
(45) Date of Patent: Dec. 25, 2018

(54) CENTRALIZER WITH INTEGRATED STOP COLLAR

(71) Applicant: Weatherford Technology Holdings, LLC, Houston, TX (US)

(72) Inventors: Christian Kiess, Hannover (DE); Sebastian F. Krieger, Hannover (DE)

(73) Assignee: WEATHERFORD TECHNOLOGY HOLDINGS, LLC, Houston, TX (US)

( * ) Notice: Subject to any disclaimer, the term of this patent is extended or adjusted under 35 U.S.C. 154(b) by 145 days.

(21) Appl. No.: 15/205,765

(22) Filed: Jul. 8, 2016

(65) Prior Publication Data

US 2017/0009536 A1 Jan. 12, 2017

Related U.S. Application Data

(60) Provisional application No. 62/190,137, filed on Jul. 8, 2015.

(51) Int. Cl.
*E21B 17/10* (2006.01)

(52) U.S. Cl.
CPC ..... *E21B 17/1078* (2013.01); *E21B 17/10* (2013.01)

(58) Field of Classification Search
CPC .. E21B 17/1078; E21B 17/10; E21B 17/1014; E21B 17/1021; E21B 17/028
See application file for complete search history.

(56) References Cited

U.S. PATENT DOCUMENTS 1,775,376 A * 9/1930 Steps ..... E21B 17/1028 166/241.6
1,998,833 A 4/1935 Crowell
2,058,310 A 10/1936 Hartman et al.
2,089,553 A 8/1937 Lartman et al.
2,344,120 A 3/1944 Baker
2,387,493 A 10/1945 Brokaw
2,460,561 A 2/1949 Winkelmann et al.
2,654,435 A 10/1953 Oliver et al.
2,841,226 A 7/1958 Conrad et al.
2,845,128 A 7/1958 Clark et al.
(Continued)

FOREIGN PATENT DOCUMENTS

DE G8903038.9 6/1989

OTHER PUBLICATIONS

Expand-O-Lizer Sub Info Sheet, BK Oil Tools B.V., Heemskerk, The Netherlands, date unknown, one page.

*Primary Examiner* — Cathleen R Hutchins
(74) *Attorney, Agent, or Firm* — Patterson + Sheridan, LLP

(57) ABSTRACT

A method and apparatus for centering a casing section in a wellbore. A centralizer includes a plurality of centralizer bow springs arranged between and around circumferences of end bands. The end bands are arranged over stop collars such that the end bands can rotate about and slide along the stop collars. At least one stop collar includes a radially-inward-extending lug that engages a groove in the stop collar. The groove limits the amount by which the end band can slide relative to the stop collar. When the centralizer is lowered into a wellbore, an interference between the lug in the end band and the groove in the stop collar can pull the centralizer into the wellbore. The pulling force can prevent the centralizer bow springs from expanding radially outward due to contact forces with edges of the wellbore.

20 Claims, 11 Drawing Sheets

(56) References Cited

U.S. PATENT DOCUMENTS

| | | | |
|---|---|---|---|
| 3,062,297 | A | 11/1962 | Tyrrell, Jr. |
| 4,077,470 | A | 3/1978 | Dane |
| 4,269,269 | A | 5/1981 | Wilson |
| 4,506,219 | A | 3/1985 | Lee |
| 4,580,632 | A | 4/1986 | Reardon |
| 4,669,541 | A | 6/1987 | Bissonnette |
| 5,033,459 | A | 7/1991 | Champeaux et al. |
| 5,238,062 | A | 8/1993 | Reinholdt |
| 5,261,488 | A | 11/1993 | Gullet et al. |
| 5,346,016 | A | 9/1994 | Wilson et al. |
| 5,575,333 | A | 11/1996 | Lirette et al. |
| 6,209,638 | B1 | 4/2001 | Mikolajczyk |
| 6,298,883 | B1 | 10/2001 | Kinzel |
| 6,298,889 | B1 | 10/2001 | Smith |
| 6,453,998 | B1 | 9/2002 | Reeve |
| 6,453,999 | B1 | 9/2002 | Reinholdt |
| 6,484,803 | B1 | 11/2002 | Gremillion |
| 7,140,432 | B2 | 11/2006 | Gremillion |
| 7,156,171 | B2 | 1/2007 | Gremillion |
| 7,182,131 | B2 | 2/2007 | Gremillion |
| 8,245,777 | B2 | 8/2012 | Gamer |
| 8,505,624 | B2 | 8/2013 | Levie |
| D718,342 | S | 11/2014 | Buytaert et al. |
| 8,991,487 | B2 | 3/2015 | Levie et al. |
| 2002/0112853 | A1 | 8/2002 | Buytaert |
| 2002/0139537 | A1 | 10/2002 | Young et al. |
| 2002/0139538 | A1 | 10/2002 | Young et al. |
| 2007/0144731 | A1 | 6/2007 | Murray et al. |
| 2007/0235199 | A1 | 10/2007 | LoGiudice et al. |
| 2008/0283237 | A1* | 11/2008 | Buytaert ..... E21B 17/1028 166/196 |
| 2010/0018698 | A1 | 1/2010 | Garner |
| 2010/0181079 | A1 | 7/2010 | Johnson et al. |
| 2012/0006533 | A1 | 1/2012 | Barnard et al. |
| 2012/0055667 | A1 | 3/2012 | Ingram et al. |
| 2012/0145410 | A1 | 6/2012 | Levie |
| 2012/0186828 | A1 | 7/2012 | Lively et al. |
| 2012/0239345 | A1 | 9/2012 | Fraser et al. |
| 2013/0025881 | A1 | 1/2013 | Buytaert et al. |
| 2013/0087334 | A1 | 4/2013 | Buytaert et al. |
| 2013/0118752 | A1 | 5/2013 | Hannegan et al. |
| 2013/0248206 | A1 | 9/2013 | Jordan et al. |
| 2013/0319689 | A1 | 12/2013 | Levie et al. |
| 2013/0319690 | A1 | 12/2013 | Levie et al. |
| 2014/0182839 | A1* | 7/2014 | McDaniel ..... E21B 17/1028 166/241.6 |
| 2015/0034336 | A1* | 2/2015 | Morrison ..... E21B 17/1028 166/381 |
| 2015/0376960 | A1 | 12/2015 | Rodrigue et al. |

* cited by examiner

CENTRALIZER WITH INTEGRATED STOP COLLAR

RELATED APPLICATIONS

This application claims the benefit of U.S. Provisional Application 62/190,137, filed on Jul. 8, 2015, the contents of which are incorporated herein in their entirety.

BACKGROUND OF THE INVENTION

Field of the Invention

Embodiments described herein generally relate to a centralizer for use in a wellbore.

SUMMARY OF THE INVENTION

According to one embodiment, a centralizer assembly for a wellbore includes a cylindrical body that includes a first end and a second end opposite the first end. The cylindrical body defines a longitudinal axis between the first end and the second end. The centralizer assembly also includes a first stop collar arranged around the cylindrical body. The first stop collar includes a first circumferential groove arranged on an exterior surface of the first stop collar. The first circumferential groove extends along the longitudinal axis. The centralizer assembly also includes a second stop collar arranged around the cylindrical body and spaced apart from the first stop collar. The centralizer assembly also includes a centralizer. The centralizer includes a first end band arranged around the first stop collar. The first end band can slide along the longitudinal axis relative to the first stop collar. The first end band includes a first lug that extends into the first circumferential groove. The centralizer also includes a second end band arranged around the second stop collar. The second end band can slide along the longitudinal axis relative to the second stop collar. The centralizer also includes a plurality of centralizer bow springs arranged between the first end band and the second end band.

According to one embodiment, a method of making a centralizer assembly for a wellbore includes stamping a metal sheet to form a first end band, a second end band, a plurality of centralizer bow springs between the end bands, and a first slot in the first end band. The method also includes rolling the stamped metal sheet such that the end bands are cylindrical. The method also includes affixing a first lug in the first slot such that the first lug extends away from the first end band in a radially inward direction. The method also includes securing the first end band around a first stop collar. The first stop collar includes a first circumferential groove arranged on an exterior surface. The first circumferential groove extends along a longitudinal axis of the first stop collar. The first lug is arranged in the first circumferential groove, and the first end band can translate along the longitudinal axis relative to the stop collar by a distance defined by a length of the first circumferential groove along the longitudinal axis. The method also includes securing the second end band around a second stop collar. The second end band can translate along a longitudinal axis of the second stop collar relative to the second stop collar. The method also includes arranging the first stop collar and the second stop collar around a cylindrical body, wherein the first stop collar and the second stop collar are spaced apart on the cylindrical body.

According to one embodiment, a centralizer assembly for a wellbore includes a cylindrical body that includes a first end and a second end opposite the first end. The cylindrical body defines a longitudinal axis between the first end and the second end. The centralizer assembly also includes a first stop collar arranged around the cylindrical body. The first stop collar includes a first circumferential groove arranged on an exterior surface of the first stop collar. The first circumferential groove extends around a circumference of the first stop collar. The first stop collar includes a first aperture in the first circumferential groove between an interior surface and the first circumferential groove. The centralizer assembly also includes a second stop collar arranged around the cylindrical body and spaced apart from the first stop collar. The centralizer assembly also includes a centralizer. The centralizer includes a first end band arranged around the first stop collar. The first end band can slide along the longitudinal axis relative to the first stop collar. The first end band includes a first slot therethrough. The centralizer also includes a first lug arranged relative to the first end band. An outer portion of the first lug is arranged in the first slot and an inner portion of the first lug extends into the first circumferential groove. The first lug includes dimensions smaller than the aperture in the first stop collar such that the first lug can pass through the first aperture to arrange the outer portion of the first lug in the first slot. The centralizer also includes a second end band arranged around the second stop collar. The second end band can slide along the longitudinal axis relative to the second stop collar. The centralizer also includes a plurality of centralizer bow springs arranged between the first end band and the second end band.

According to one embodiment, a method of making a centralizer assembly for a wellbore includes stamping a metal sheet to form a first end band, a second end band, a plurality of centralizer bow springs between the end bands, and a first slot in the first end band. The method also includes affixing free ends of the end bands such that the end bands are cylindrical. The method also includes arranging a first stop collar within the first cylindrical end band. The first stop collar includes a first circumferential groove arranged on an exterior surface of the first stop collar. The first circumferential groove extends around a circumference of the first stop collar. The first stop collar includes a first aperture in the first circumferential groove between an interior surface and the first circumferential groove. The method also includes inserting a first lug through the first aperture and affixing the first lug in the first slot in the first end band. The first lug includes a portion that extends into the first circumferential groove when the first lug is affixed in the first slot. The method also includes arranging a second stop collar within the second cylindrical end band. The method also includes arranging the first cylindrical end band and the second cylindrical end band around a cylindrical body.

According to one embodiment, a centralizer assembly for use with a wellbore includes a cylindrical body that includes a first end and a second end opposite the first end. The cylindrical body defines a longitudinal axis between the first end and the second end. The centralizer assembly also includes a first stop collar, a second stop collar, and a third stop collar arranged around the cylindrical body. The stop collars are spaced apart from each other along the longitudinal axis. The centralizer assembly also includes a centralizer that includes a first end band arranged around the first stop collar and the second stop collar. The first end band can slide along the longitudinal axis relative to the first stop collar and the second stop collar. The first end band includes a first lug that extends into a gap between the first stop collar and the second stop collar. The centralizer also includes a second end band arranged around the third stop collar. The second end band can slide along the longitudinal axis relative to the third stop collar. The centralizer also includes a plurality of centralizer bow springs arranged between the first end band and the second end band.

According to one embodiment, a method for making a centralizer assembly for a wellbore includes arranging a first stop collar around a cylindrical body. The cylindrical body defines a longitudinal axis. The method also includes arranging a second stop collar around the cylindrical body. The second stop collar is spaced apart from the first stop collar along the longitudinal axis. The method also includes arranging a centralizer around the cylindrical body, the first stop collar, and the second stop collar. The centralizer includes a first end band, a second end band, a plurality of centralizer bows arranged between the first end band and the second end band, and a first lug extending radially inward from the first end band. The first end band is arranged over the first stop collar such that the first stop collar is between the first lug and the second stop collar. The second end band is arranged over the second stop collar. The method also includes arranging a third stop collar around the cylindrical body. The third stop collar is spaced apart from the first stop collar and the first lug extends into a gap between the first stop collar and the third stop collar.

According to one embodiment, a centralizer assembly for a wellbore includes a cylindrical body that includes a first end and a second end opposite the first end. The cylindrical body defines a longitudinal axis between the first end and the second end. The centralizer assembly also includes a first stop collar arranged around the cylindrical body. The first stop collar includes a first inward-facing circumferential groove arranged on an interior surface of the first stop collar and a second inward-facing circumferential groove arranged on an interior surface of the first inward-facing circumferential groove. The first inward-facing circumferential groove and the second inward-facing circumferential groove extend around a circumference of the first stop collar. The first stop collar includes a first aperture in the first and second inward-facing circumferential grooves. The centralizer assembly also includes a centralizer. The centralizer includes a first end band arranged between the first stop collar and the cylindrical body in the first inward-facing circumferential groove. The first end band can slide along the longitudinal axis relative to the first stop collar. The first end band includes a first slot therethrough. The centralizer also includes a first lug arranged relative to the first end band. An inner portion of the first lug is arranged in the first slot and an outer portion of the first lug extends into the second inward-facing circumferential groove. The first lug includes dimensions smaller than the aperture in the first stop collar such that the first lug can pass through the first aperture to arrange the inner portion of the first lug in the first slot. The centralizer also includes a second end band that can slide along the longitudinal axis. The centralizer also includes a plurality of centralizer bow springs arranged between the first end band and the second end band.

According to one embodiment, a method of making a centralizer assembly for a wellbore comprises stamping a metal sheet to form a first end band, a second end band, a plurality of centralizer bow springs between the end bands, and a first slot in the first end band. The method also includes affixing free ends of the end bands such that the end bands are cylindrical. The method also includes arranging a first stop collar around the first cylindrical end band. The first stop collar includes a first inward-facing circumferential groove arranged on an interior surface of the first stop collar and a second inward-facing circumferential groove arranged on an interior surface of the first inward-facing circumferential groove. The first inward-facing circumferential groove and second inward-facing circumferential groove extend around a circumference of the first stop collar. The first stop collar includes a first aperture in the first and second inward-facing circumferential grooves. The method also includes inserting a first lug through the first aperture and affixing the first lug in the first slot in the first end band. The first lug includes an outer portion that extends into the second inward-facing circumferential groove when the first lug is affixed in the first slot. The method also includes arranging the first cylindrical end band and the second cylindrical end band around a cylindrical body.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1:
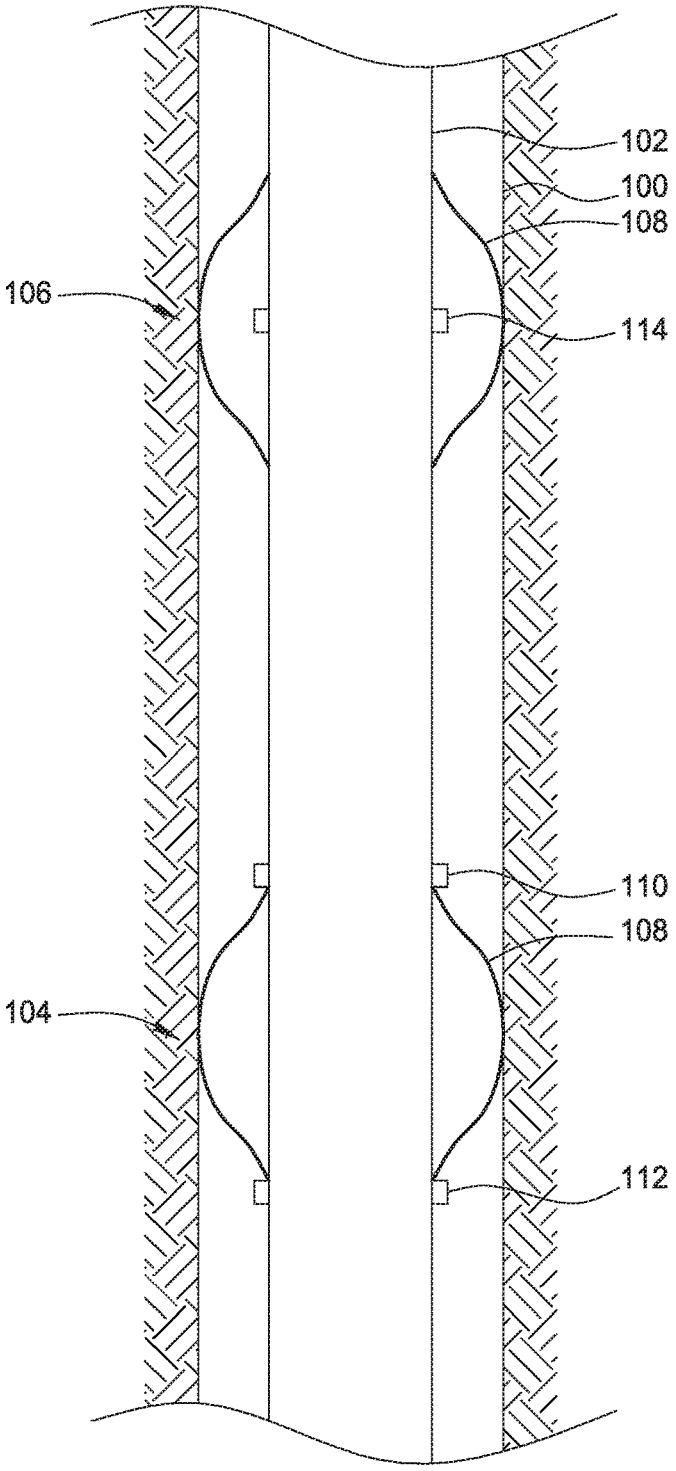
FIG. 1 is a cross-sectional side view of a casing string section in a wellbore with two different centralizer arrangements thereon.

Referring to FIG. 1, when running a casing string 102 or drill pipe (hereinafter referred to generally as a casing string) in a wellbore 100, centralizers can be used to center the casing string 102 in the wellbore 100. FIG. 1 illustrates two existing types of centralizers: a between stop collar centralizer assembly 104 and an over stop collar centralizer assembly 106. The between stop collar centralizer assembly 104 includes a centralizer 108 with centralizer bow springs that extend radially outward to contact the wellbore 100. The centralizer assembly 104 also includes a first stop collar 110 and a second stop collar 112. The centralizer 108 is positioned between the first stop collar 110 and the second stop collar 112. The stop collars 110 and 112 are attached to the casing string 102 and constrain the centralizer 108 along the casing string 102 between the stop collars 110 and 112. The over stop collar centralizer 106 also includes a centralizer 108 with centralizer bow springs that extend radially outward toward the wellbore 100. Here, the centralizer 108 is positioned over a single stop collar 114 arranged under the bows of the centralizer 108. The single stop collar 114 constrains the centralizer 108 along the casing string 102 because ends of the centralizer 108 cannot pass over the stop collar 114. In many aspects, the casing string 102 rotates as it is lowered into the wellbore 100, and the stop collars 110 and 112 rotate with the casing string 102. In many instances, it is desirable for the centralizer 108 to not rotate as the casing string 102 (and the centralizer 108) is lowered into the wellbore 100. If the centralizer 108 rotates with the casing string 102 as the casing string 102 is lowered into the wellbore 100, the centralizer bow springs of the centralizer 108, extending radially outward to the wellbore 100, could ream the walls of the wellbore 100.

Figure 2B:
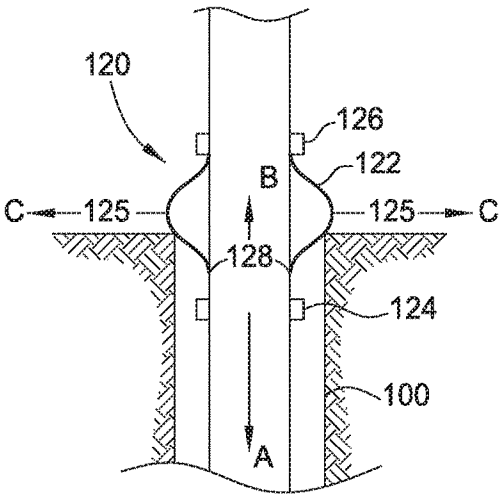
FIG. 2B is a cross-sectional side view of the casing string section of FIG. 2A being lowered further into the wellbore, wherein portions of the centralizer bow springs have contacted surfaces of the wellbore and are being displaced in a radially-outward direction.
Figure 2C:
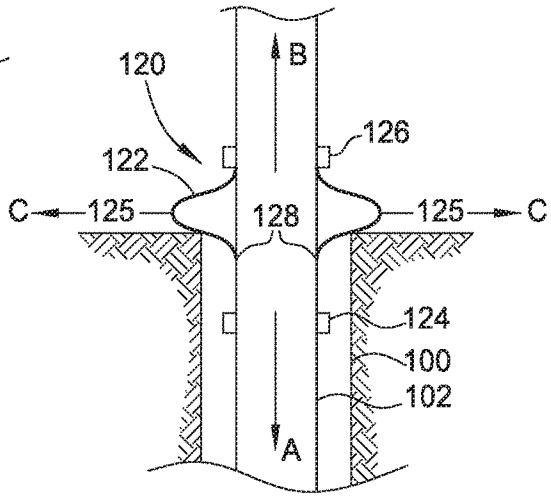
FIG. 2C is a cross-sectional side view of the casing string section of FIG. 2A being lowered further into the wellbore than in FIG. 2B, wherein portions of the centralizer bow springs are further displaced radially-outward by contact with surfaces of the wellbore.
Figure 2A:
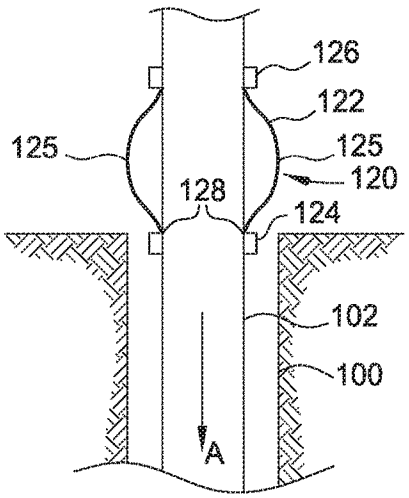
FIG. 2A is a cross-sectional side view of a casing string section being lowered into a wellbore, wherein a between-stop-collar centralizer includes centralizer bow springs that extend radially outward and wherein the between-stop-collar centralizer is positioned above the wellbore.

One issue with between stop collar centralizer assemblies 104 is that installation into a wellbore 100 can be difficult if the centralizer bow springs of the centralizer 108 extend radially outward past the walls of the wellbore 100. FIG. 2A illustrates a between stop collar centralizer assembly 120 arranged on the casing string 102 above the wellbore 100. As indicated by arrow A, the casing string 102 is being lowered into the wellbore 100. The between stop collar centralizer assembly 120 includes a first stop collar 124 and a second stop collar 126. The centralizer 122 is arranged between the stop collars 124 and 126. The widest portion 125 of the centralizer 122 is wider than the wellbore 100. A downhole end 128 of the centralizer 122 rests against the first stop collar 124. The centralizer 122 is not connected to the stop collars 124 and 126 so that the centralizer 122 does not rotate with the casing string 102 or the stop collars 124 and 126. Referring to FIG. 2B, as the casing string 102 is lowered into the wellbore 100, the widest portion 125 of the centralizer 122 contacts the wellbore 100. Contact forces between the centralizer 122 and the wellbore 100 can prevent or inhibit the widest portion 125 of the centralizer 122 from moving downhole in the direction of arrow A. At the same time, the stop collar 126 above the centralizer 122 exerts a downward force on the centralizer 122. As a result, the downhole end 128 of the centralizer 122 can slide in the direction of arrow B relative to the casing string 102 and the stop collars 124 and 126, and the widest portions 125 of the centralizer 122 can move radially outward in the direction of arrows C. Referring to FIG. 2C, continued downhole movement of the casing string 102 in the direction of arrow A can cause the downhole end 128 of the centralizer 122 to slide further in the direction of arrow B and cause the widest portion 125 of the centralizer 122 to move further radially outward in the direction of arrows C. In various circumstances, the centralizer 122 could effectively jam, preventing the casing string 102 from continuing in the downhole direction of arrow A. Consequently, this centralizer 122 in a between stop collar centralizer assembly 120 usually have dimensions that are either smaller or marginally larger than the dimensions of the wellbore 100. When a centralizer is pushed into a wellbore 100, there are larger starting forces and running forces to overcome than when a centralizer is pulled into the wellbore 100.

The over stop collar centralizer 106 illustrated in FIG. 1 may not suffer the jamming problems that the between stop collar centralizer assembly 104 can have, as discussed above with reference to FIGS. 2A-2C. However, the over stop collar centralizer 106 arrangement can be very difficult to manufacture and/or assemble. In various instances, an over stop collar centralizer 106 arrangement may not be possible due to design or space restrictions (e.g., space between the casing and the hole).

In various embodiments described herein, a centralizer can be arranged on top of stop collars such that the centralizer can rotate relative to the stop collars, but the stop collars limit movement of the centralizer along the longitudinal axis of the casing string. As a result, a downhole stop collar in a top of stop collar arrangement can pull the centralizer into the wellbore, and prevent the bowing issue discussed above with reference to FIGS. 2A-2C.

Figure 3A:
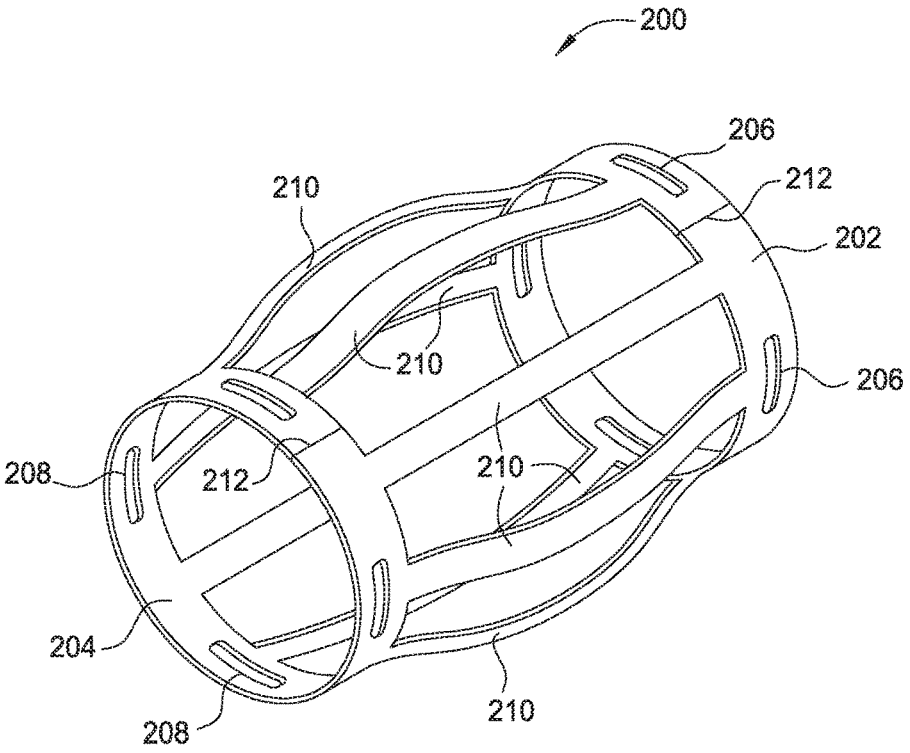
FIG. 3A is a perspective view of a centralizer according to various embodiments, wherein the centralizer includes end bands and centralizer bow springs between the end bands, and wherein the end bands include slots therein.
Figure 3B:
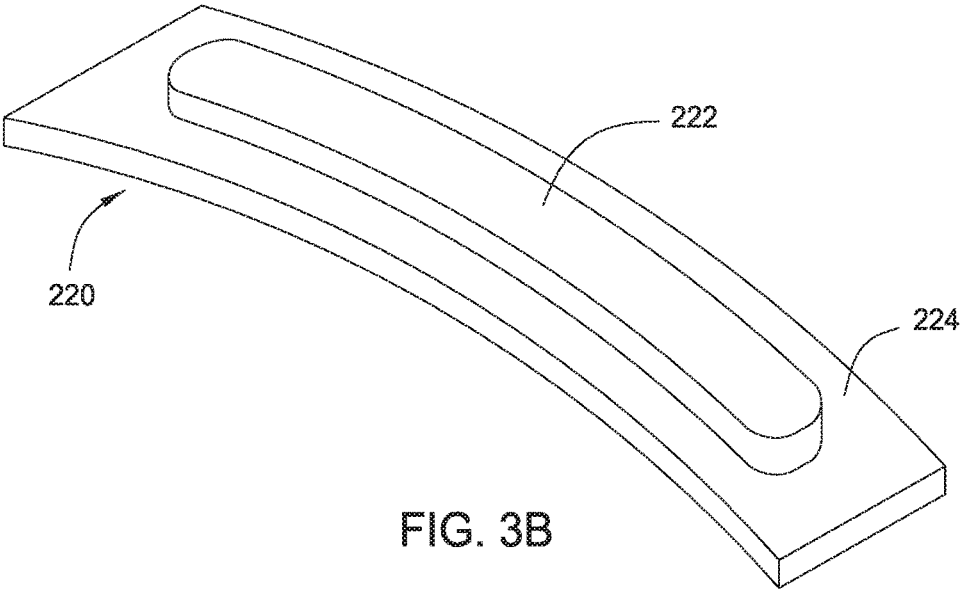
FIG. 3B is a perspective view of lugs that can be arranged in the slots in the end bands of the centralizer shown in FIG. 3A.

FIG. 3A is a perspective view of a centralizer 200 for use in various embodiments described herein. The centralizer 200 includes a first end band 202 and a second end band 204 with a plurality of centralizer bows 210 between the end bands 202 and 204. The centralizer bow springs 210 are arranged around a circumference of the end bands 202 and 204. In various embodiments, the first end band 202 includes one or more slots 206 there through. In the embodiment shown in FIG. 3A, the first end band 202 includes four slots 206 arranged around the circumference of the first end band 202. In various embodiments, the second end band 204 includes one or more slots 208 there through. Again, in the embodiment shown in FIG. 3A, the second end band 204 includes four slots 208 arranged around the circumference of the first end band 204. The number of slots 206 and 208 may be proportional to the number of centralizer bows 210, such as a slot 206 and 208 for every other centralizer bow spring 210 or a slot 206 and 208 for every centralizer bow spring 210. The slot 206 and 208 may be aligned with the centralizer bow springs 210. Each slot 206 and 208 may be circumferential and have a width according to the spacing between each centralizer bow spring 210 or a width corresponding to the width of each centralizer bow spring 210. FIG. 3B illustrates a lug 220 that can be inserted into a slot 206 in the first end band 202 or a slot 208 in the second end band 204. The lug 220 includes an outer portion 222 and an inner portion 224. The outer portion 222 includes a profile that matches a profile of the slots 206 and 208. The outer portion 222 can be inserted into a slot 206 or 208 and attached therein. The inner portion 224 extends radially inward from the first end band 202 or the second end band 204.

The centralizer 200 may be of one piece construction and may be made from ductile metal or alloy, such as steel. The steel may be plain carbon or low alloy steel and not boron steel. The centralizer 200 may be formed from a pipe or may be formed starting with sheet-metal. The sheet-metal may be cut to form the centralizer bow springs and the slots 206 and 208. For example, the bow strips and the slots 206 and 208 may be formed by a CNC machine tool having a laser, plasma, or waterjet cutter. The sheet may then be formed into a split cylindrical shape, such as by hot or cold forming. The hot or cold forming may be pressing or rolling. The bow strips may then be plastically expanded into the centralizer bow springs 210. The lugs 220 may then be inserted into the respective slots 206 and 208 from underneath the respective end bands 202 and 204. The lugs 220 may then be mounted to the respective end bands 202 and/or 204, such as by fusion welding. A protective coating may then be applied to the split cylindrical assembly to resist corrosion in the wellbore (e.g., wellbore 100). Ultimately, forming the centralizer 200 may be completed by joining ends of the split cylindrical assembly (which form a seam 212), such as by seam welding. The seam welding may be accomplished by electric resistance welding. The seam weld may be a butt joint. A protective coating may then be applied to the seam weld. As discussed in greater detail below, the time when the ends of the split cylindrical assembly are joined varies for the different embodiments described below. The centralizer may be heat treated during or at the end of the process. In one embodiment, the heat treatment occurs before the coating or before the centralizer is installed on the stop collar. The centralizer may be heat treated with the lugs in place or before the lugs are in place. When the centralizer is made from pipe, the centralizer may be cut open in certain embodiments to be placed around a pipe.

Figure 4A:
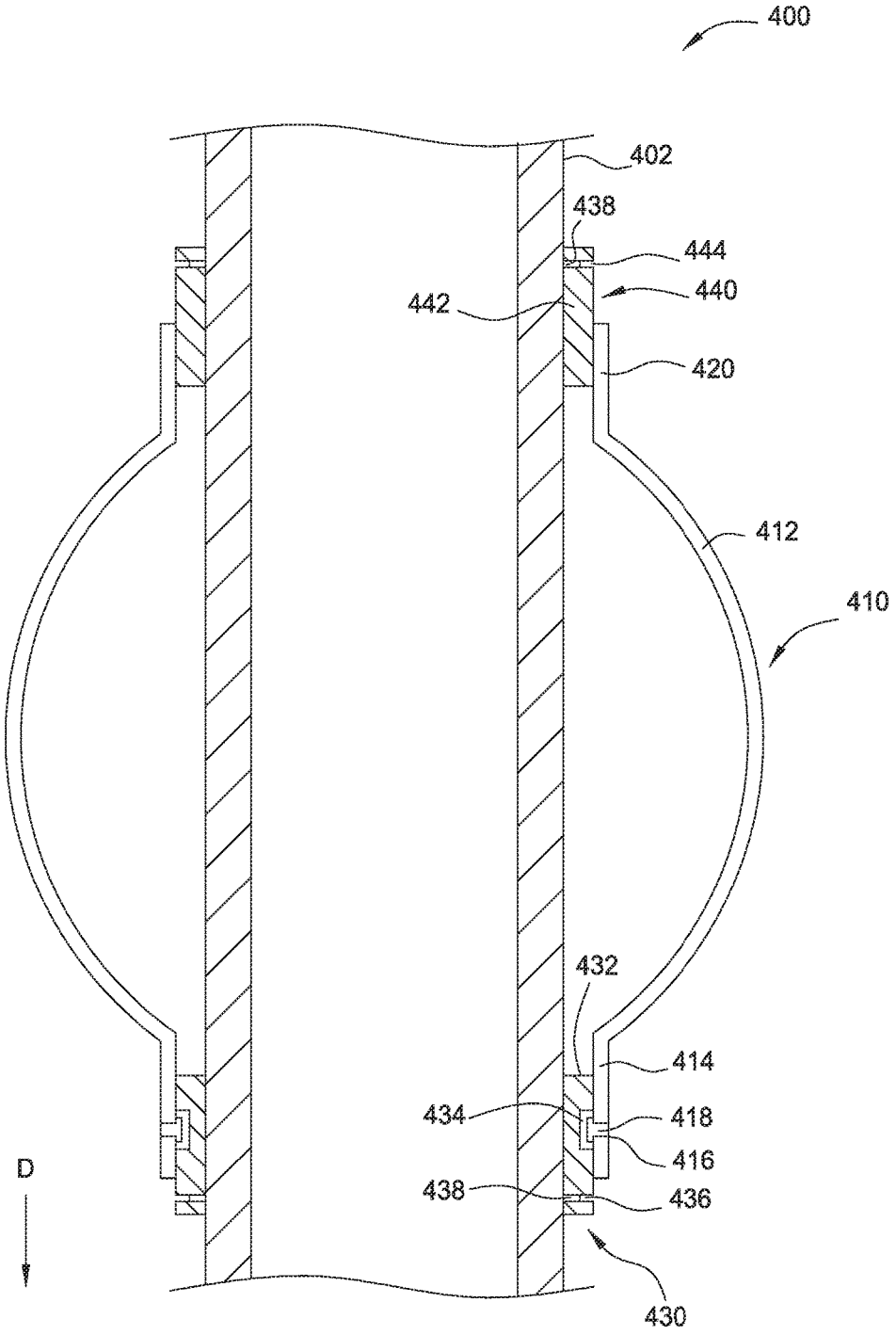
FIG. 4A is a cross-sectional side view of a centralizer assembly according to at least one embodiment.

FIG. 4A illustrates an embodiment of a centralizer assembly 400 in which a centralizer 410 is arranged over a first stop collar 430 and a second stop collar 440. The centralizer assembly 400 is arranged around a body of a casing section 402. In various embodiments, the centralizer assembly 400 includes the body of the casing section 402. The centralizer 410 includes centralizer bow springs 412 arranged between a first end band 414 and the second end band 420. The first end band 414 is arranged over a first stop collar 430. The first stop collar 430 includes a body 432 with a circumferential groove 434 arranged therearound. One or more lugs 418 are arranged in respective one or more slots 416 of the first end band 414. For example, the lugs 418 could be similar to the lugs 220 shown in FIG. 3B. The lugs can extend radially inward into the circumferential groove 434 in the body 432 of the stop collar 430. The lugs 418 can enable the end band 414 to rotate relative to the stop collar 430. As described in greater detail below, the lugs 418 can allow the end band 414 to slide relative to the stop collar 430, but only to a limited extent. In the embodiment shown in FIG. 4A, the second end band 420 is arranged on top of a second stop collar 440. In this embodiment, the second stop collar 440 has a body 442 that does not include a circumferential groove, and the end band 420 does not include a lug. As a result, the end band 420 can slide freely on the stop collar 440. The first stop collar 430 includes a plurality of threaded holes 436 arranged around its circumference and the second stop collar 440 includes a plurality of threaded holes 444 arranged around its circumference. Set screws 438 can be inserted and threaded into the threaded holes 436 and 444 in the first stop collar 430 and the second stop collar 440, respectively. The set screws 438 can be threaded such that they contact the casing section 402 below. The set screws 438 can include a biting front face that presses into the casing section 402. The interface between the biting front face of the set screws 438 and the casing section 402 can hold the stop collars 430 and 440 in place against the casing section 402. In various other embodiments, the stop collars 430 and 440 could be held in place by adhesives, rivets, welds, spiral nails or other suitable fasteners.

The engagement of the lugs 418 in the circumferential grooves 434 allows the end band 414 and the lugs 418 to rotate about the stop collar 430 and also provides for a contact force such that the first stop collar 430 can pull the centralizer 410 into the wellbore. The lug 418 allows the end band 414 to slide by a certain amount relative to the first stop collar 430 before the lug 418 abuts the groove 434 in the first stop collar 430 as the casing string 402 and the stop collars 430 and 440 are lowered into a wellbore in the direction of arrow D. Once the lug 418 abuts the groove 434, the stop collar 430 will pull the centralizer 410 into the wellbore. Referring again to FIGS. 2A-2C, the pulling force by the stop collar 430 on the end band 414 prevents the centralizer 410 from bowing radially outward (in the direction of arrows C depicted in FIGS. 2B and 2C).

Figure 4B:
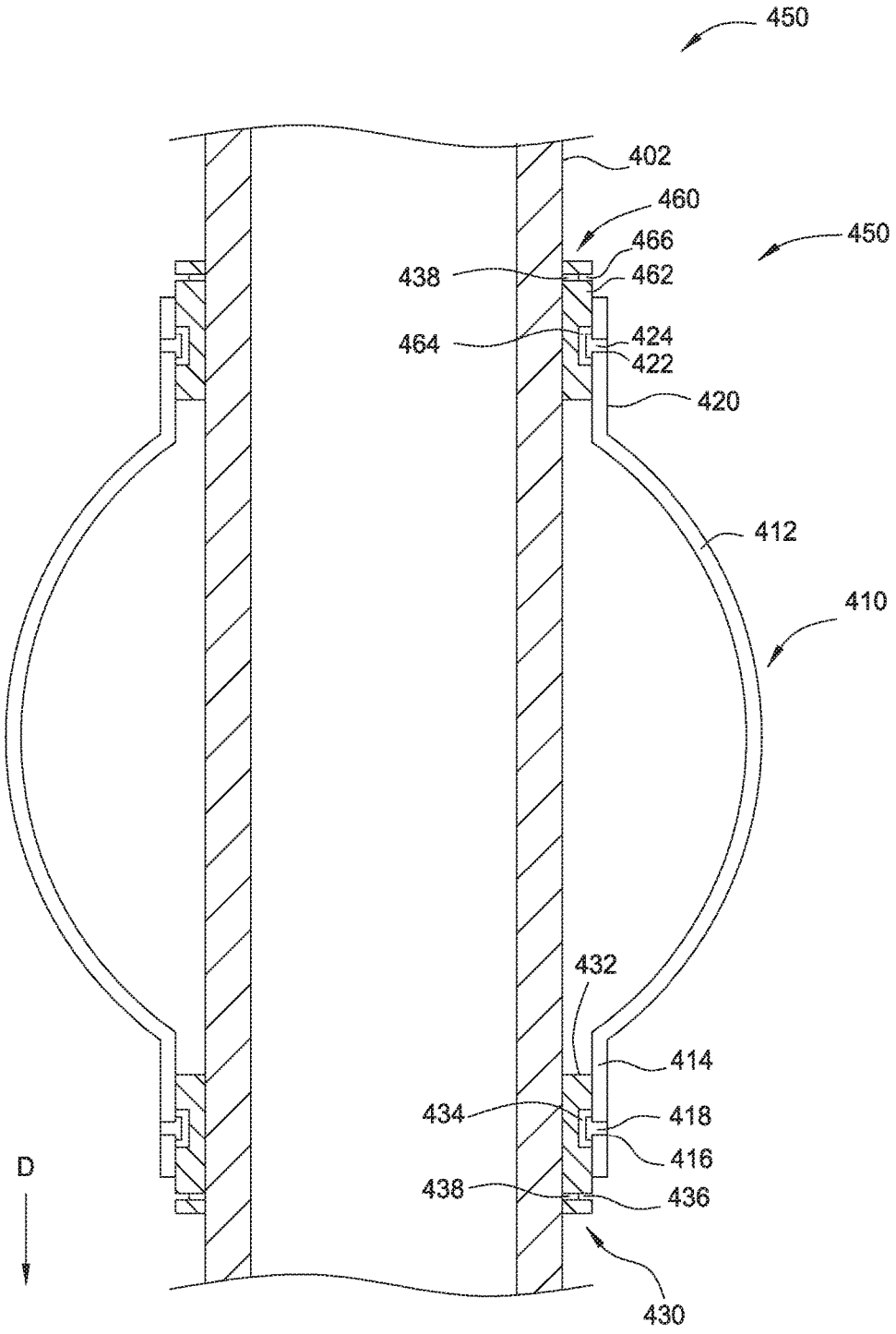
FIG. 4B is a cross-sectional side view of a centralizer assembly according to at least one embodiment.

Referring now to FIG. 4B, in various instances, the casing string 402 may need to be removed from the wellbore. FIG. 4B illustrates an embodiment of a centralizer assembly 450 in which the body 462 of the second stop collar 460 also has a circumferential groove 464 and the second end band 420 includes one or more slots 422 with lugs 424 arranged in the respective one or more slots 422. Again, the lugs 424 engage the circumferential groove 464 and the engagement between the lugs 424 and the circumferential grooves 464 limits sliding motion between the second end band 420 and the second stop collar 460. In the event the casing string 402 needs to be removed from the wellbore, the lug 424 can abut an edge of the circumferential groove 464 such that the second stop collar 460 can exert a pulling force on the centralizer 410. The pulling force by the stop collar 460 on the end band 420 can prevent the centralizer 410 from bowing radially outward (in the direction of arrows C depicted in FIGS. 2B and 2C).

Figure 5A:
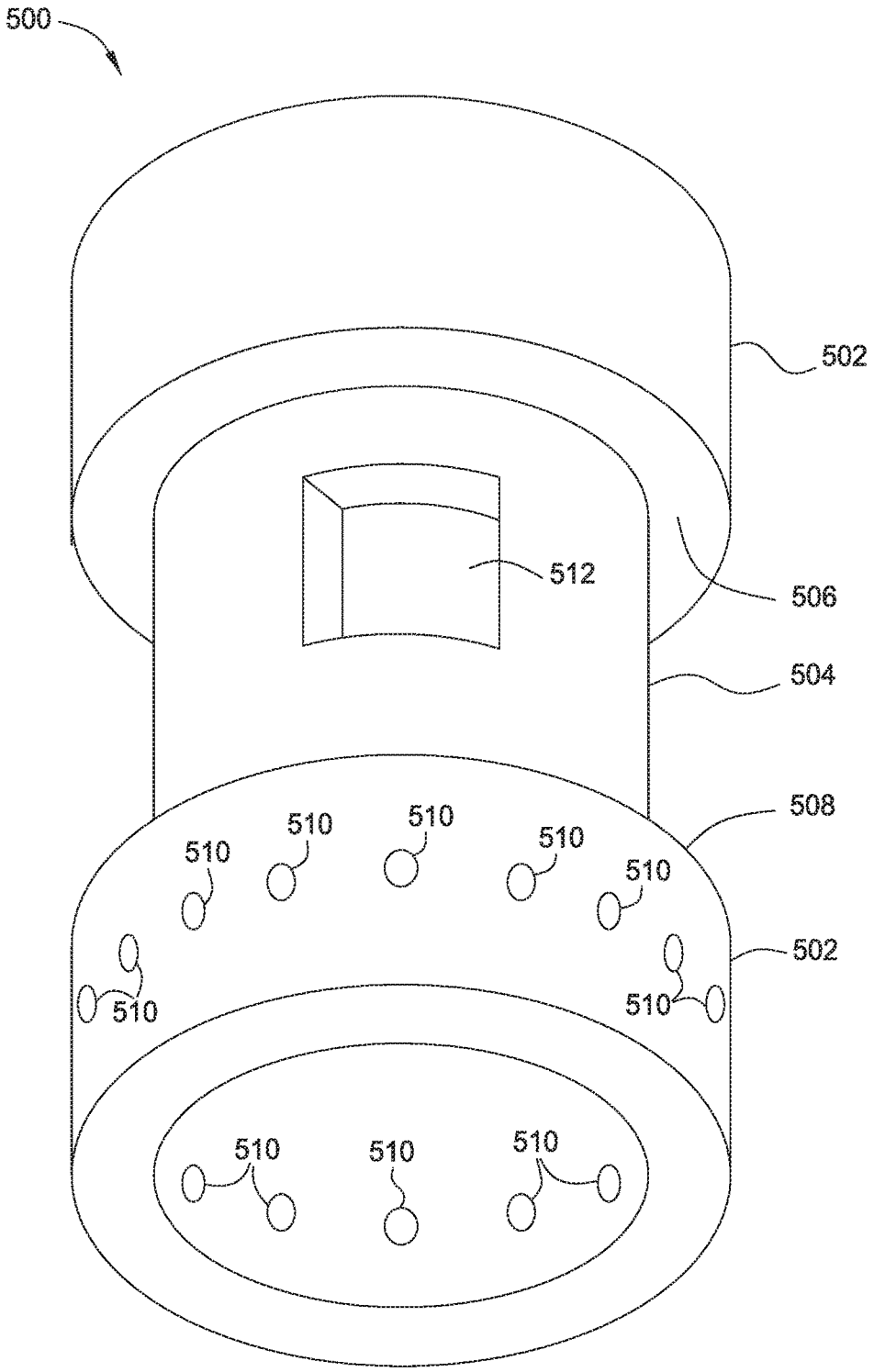
FIG. 5A is a perspective view of a stop collar according to at least one embodiment.

FIG. 5A is a perspective view of a stop collar 500 that includes a circumferential groove 504 in a body 502 of the stop collar 500. A first wall 506 and a second wall 508 define ends of the circumferential groove 504 in the body 502. The body 502 also includes the plurality of threaded holes 510 for receiving set screws 514 (e.g., set screws 438 shown above in FIGS. 4A and 4B). Referring again to FIGS. 3A-3B and 4A-4B, to form the centralizer band 410 shown in FIGS. 4A and 4B, any lugs 418 and 424 would be installed in the end band's 414 and 420. The end band's 414 and 420 would then be placed around the stop collars 430 and 440 or 460 before the seams (e.g., seam 212) are seam welded. By seam welding the end band's 414 and 420 around the stop collars 430 and 440, 460, the lugs 418 and 424 are captured in the circumferential grooves 434 and 464 (where applicable). The stop collars 430 and 440, 460 can be placed on the casing string 420 before or after the centralizer 410 is seam welded around the stop collars.

In various embodiments, the casing section 402 could be a casing string section such as a 30 foot section of casing pipe that is inserted into a wellbore. For example, the subject casing string section 402 could be attached to a casing string section that has already been placed in the wellbore and another casing string section could be placed on top of the subject casing string section 402. In various other embodiments, the casing section 402 could be a casing sub. The casing sub could be a relatively-short section of casing with a length sufficient to house the first stop collar 430, the second stop collar 440, and the centralizer 410 thereon. In the various embodiments described below, the centralizers and stop collars are described as being arranged on a casing section, but could be similarly arranged on a casing sub. Additionally, in all embodiments, the casing section or casing sub could be a drill string or drill sub.

Figure 5B:
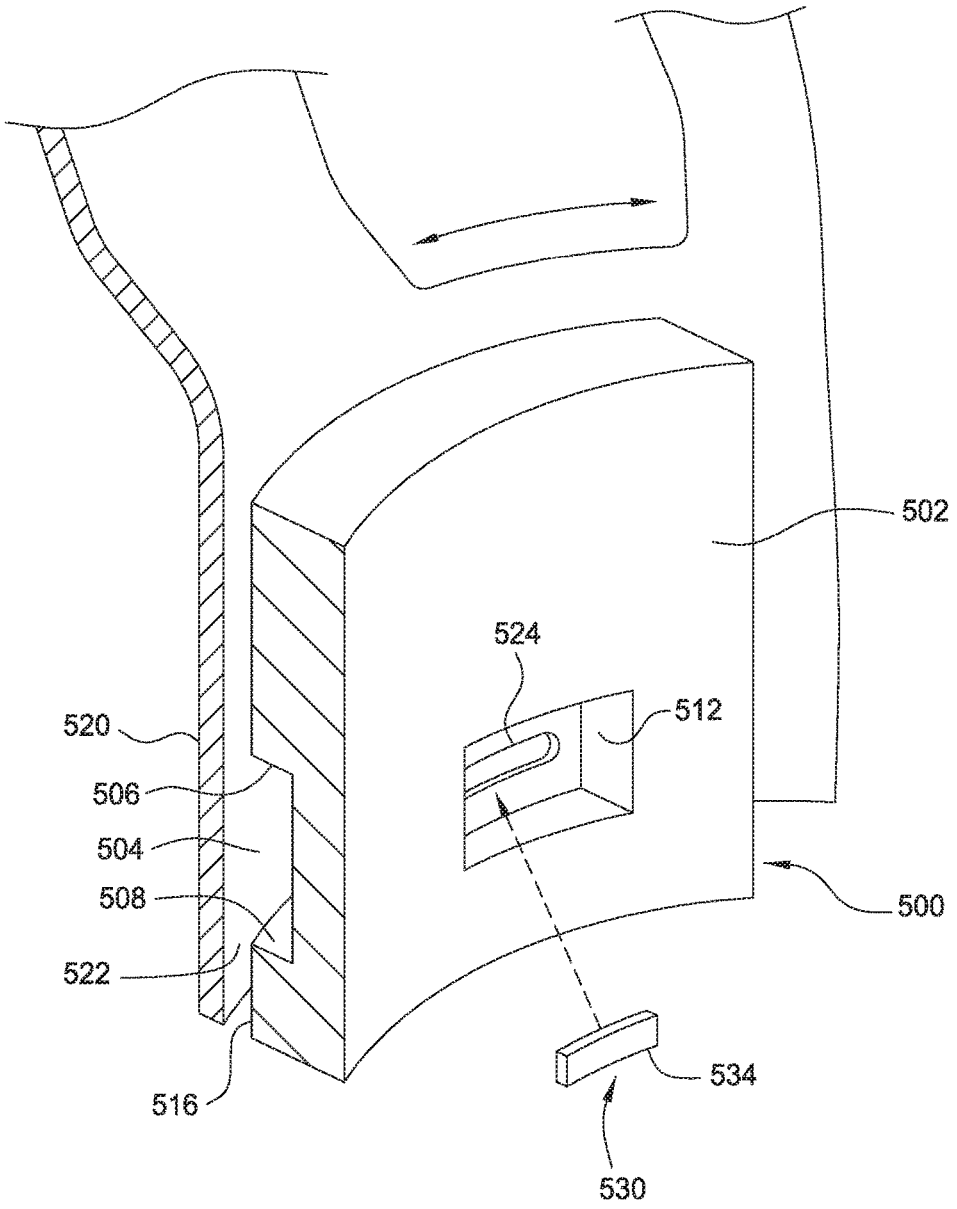
FIG. 5B is a partial perspective cross-sectional view of the stop collar of FIG. 5A, in which a lug is passing through an aperture in the stop collar to be positioned in a slot in an end band of a centralizer.

In various embodiments described below, the stop collar 512 can include an aperture 512 that passes through the body 402 at the circumferential groove 504. Referring to FIG. 5B, the aperture 512 is sized so that a lug 530 can pass therethrough. By using such a stop collar 500 with an aperture 512, a centralizer (e.g., centralizer 200 shown in FIG. 3A) could be seam welded before being placed around stop collars. For example, the centralizer could be seam welded using a jig or the like, which could simplify and/or ease the seam welding process. The end bands of the centralizer could then be placed over the stop collar 500. FIG. 5B is a perspective cross-sectional view showing a portion of a centralizer (after seam welding) and showing a portion of an end band 520 arranged around the stop collar 500. The stop collar 500 and/or the end band 520 can be rotated to align a slot 524 in the end band 520 with the aperture 512 in the stop collar 500. Thereafter, a lug 530 can be inserted through the aperture 512 and into the slot 524. The lug 530 can then be secured in the slot by welding or the like, discussed above. In embodiments in which the end band 520 includes multiple slots 524 arranged around its circumference, the stop collar 500 and/or the end band 520 can be rotated to align the aperture 512 and the stop collar 500 with each of the slots 520 to allow placement of the lugs 530.

Figure 5C:
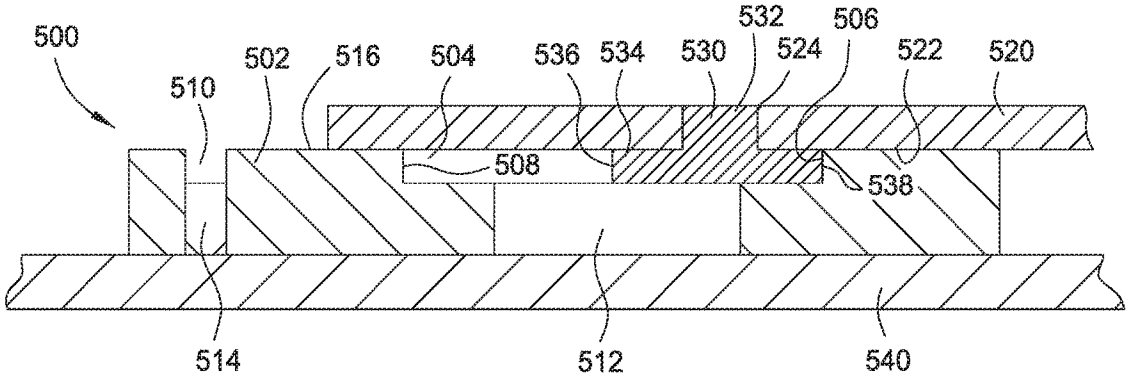
FIG. 5C is a partial cross-sectional side view of the stop collar of FIG. 5A in which an end band surrounds the stop collar and is restrained in a first direction by a lug abutting a first end of a circumferential groove in the stop collar.
Figure 5D:
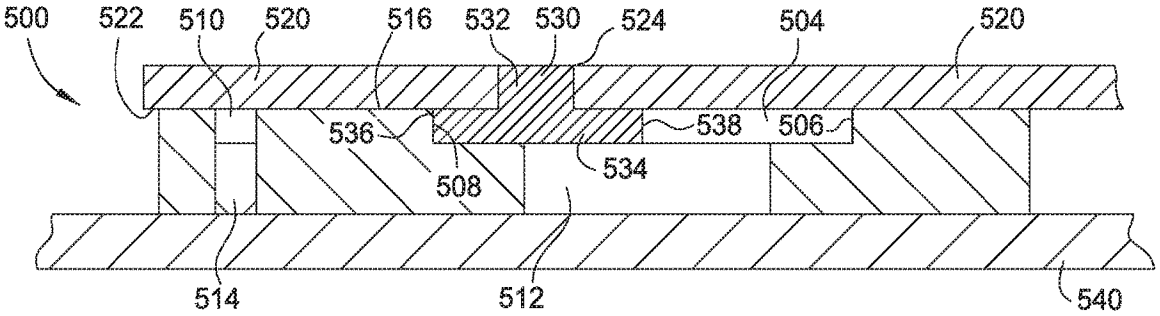
FIG. 5D is a partial cross-sectional side view of the stop collar of FIG. 5A in which an end band surrounds the stop collar and is restrained in a first direction by a lug abutting a second end of the circumferential groove in the stop collar that is opposite of the first end of FIG. 5C.

FIGS. 5C and 5D illustrate the lug 530 arranged in the circumferential groove 504 of the stop collar 500. The stop collar 500 is arranged around a body 540 of a centralizer sub or a casing string section, as described above. As shown, the end band 520 surrounds the stop collar 500 such that an inner surface 522 of the end band 520 abuts or is closely spaced from an outer surface 516 of the stop collar 500. The lug 530 includes an outer portion 532 that is attached to the slots 524 in the end band 520. The lug 530 also includes an inner portion 534 that extends radially inward from the end band 520 into the circumferential groove 504 of the stop collar 500. FIG. 5C illustrates the end band 520 at a first end of its range of motion relative to the stop collar 500. As shown in FIG. 5C, movement of the end band 520 relative to the stop collar 500 is limited by the wall 506 of the circumferential groove 504 abutting an end 538 of the inner portion 534 of the lug 530. FIG. 5D illustrates the end band 520 at a second end (opposite the first end) of its range of movement relative to the stop collar 500. As shown in FIG. 5D, movement of the end band 520 relative to the stop collar 500 is limited by the wall 508 of the circumferential groove 504 abutting an end 536 of the lug 530.

Figure 6:
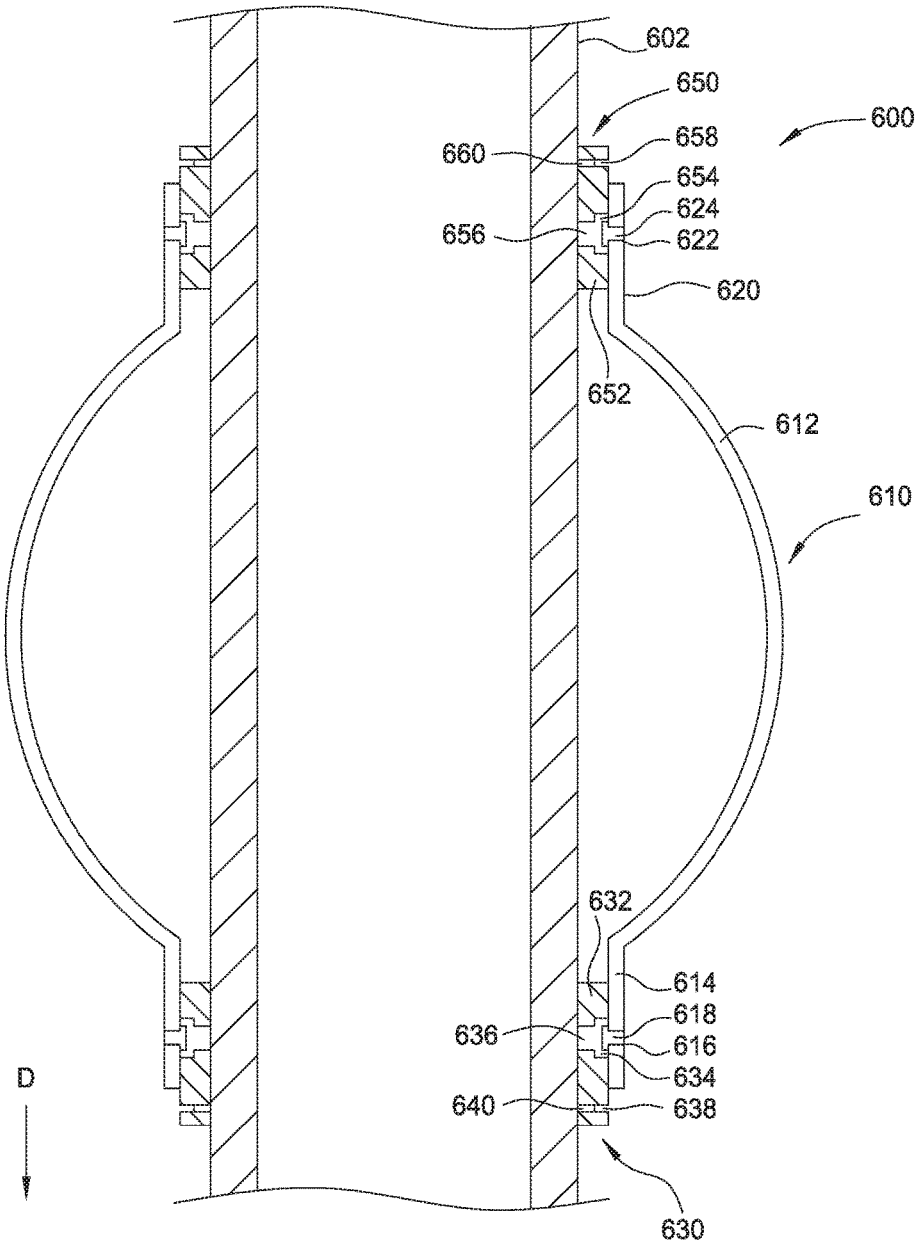
FIG. 6 is a cross-sectional side view of a centralizer assembly according to at least one embodiment.

FIG. 6 illustrates a centralizer assembly 600 in which a centralizer 610 with a plurality of centralizer bow springs 612 is arranged over two stop collars 630 and 650. A first end band 614 of the centralizer 610 is arranged over a first stop collar 630 and a second end band two 620 is arranged over a second stop collar 650. The first end band 614 includes one or more lugs 618 arranged in slots 616 around the first end band 614 and the second end band 620 includes one or more lugs 624 arranged in slots 622 around the second end band 620. The first stop collar 630 includes a circumferential groove 634 arranged in a body 632 of the stop collar 630 and an aperture 636 through the body 632. Similarly, the second stop collar 650 includes a circumferential groove 654 and a body 652 of the second stop collar 650. The second stop collar 650 also includes an aperture 656 through the body 652 and in the circumferential groove 654. As discussed above with reference to FIGS. 5A and 5B, the centralizer assembly 600 can be formed by arranging the first stop collar 630 within the first end band 614 and the second stop collar 650 within the second end band 620. The one or more lugs 618 for the first end band 630 can be inserted one at a time through the aperture 636 in the first stop collar 630. After a first lug 618 has been inserted into a first slot 616 of the first stop collar 630, the first stop collar 630 can be rotated to align the aperture 636 with a second slot 616 such that a second lug 618 can be inserted into the second slot 616. Similarly, the one or more lugs 624 for the second end band 650 can be inserted one at a time through the aperture 656 in the second stop collar 650. After a first lug 624 has been inserted into a first slot 622 of the second stop collar 650, the second stop collar 650 can be rotated to align the aperture 656 with a second slot 622 such that a second lug 624 can be inserted into the second slot 622. After the lugs 618 and 624 have been inserted through the apertures 636 and 656, respectively, the centralizer 610 is retained on the stop collars 630 and 650. Thereafter, the stop collars 630 and 650 (and the centralizer 610 thereon) can be arranged over a casing section 602. After the stop collar 630 and 650 have been arranged over the casing section 602 (with the centralizer 610 thereon), set screws 640 can be inserted into threaded holes 638 to secure the first stop collar 630 to the casing section 602. Similarly, set screws 660 can be inserted into threaded holes 658 to secure the second stop collar 650 to the casing section 602.

Figure 7:
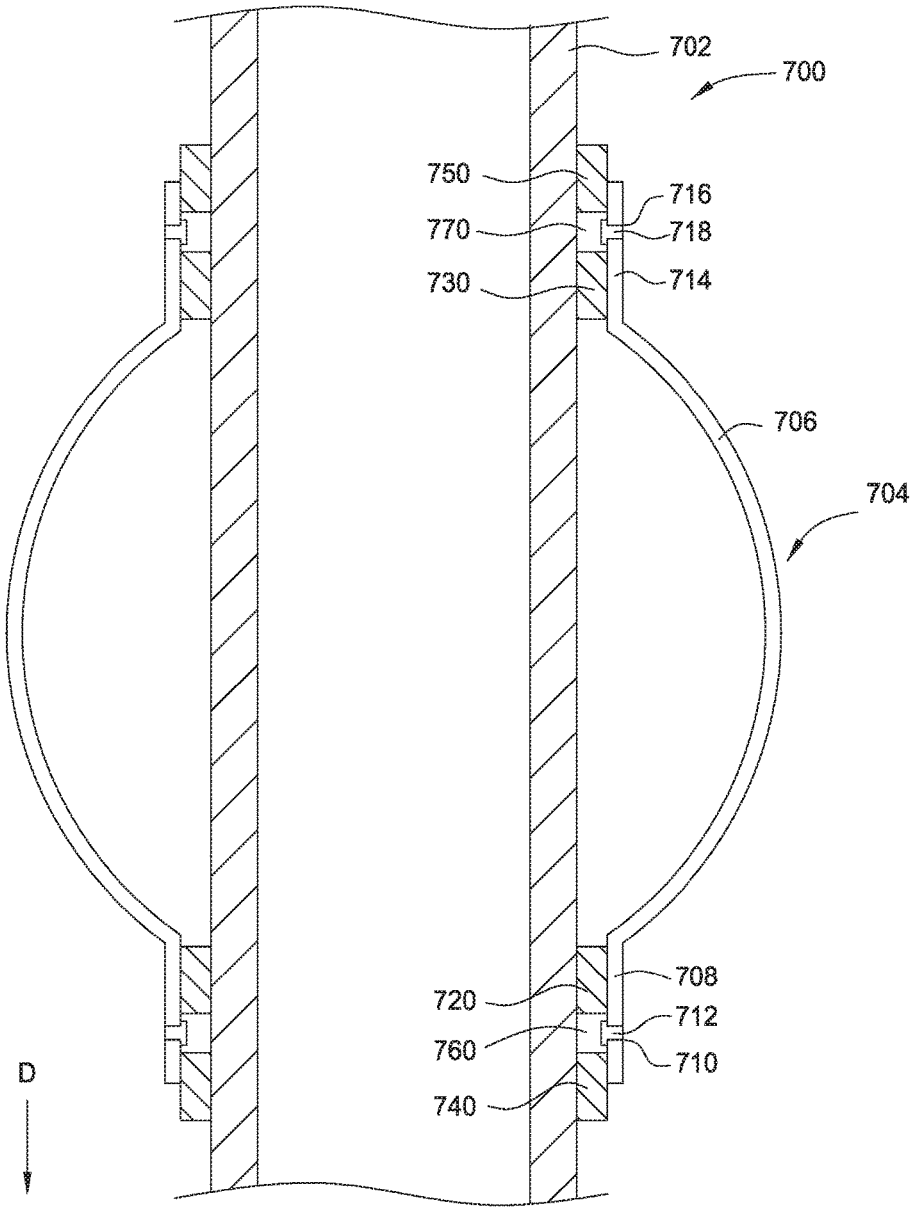
FIG. 7 is a cross-sectional side view of a centralizer assembly according to at least one embodiment.

FIG. 7 illustrates a centralizer assembly 700 in which a centralizer 704 with a plurality of centralizer bow springs 706 between end bands 708 and 714 is arranged over at least three stop collars. The first end band 708 includes one or more lugs 712 arranged in one or more slots 710 in the first end band 708. The second end band 714 could include one or more lugs 718 that are similarly arranged in one or more slots 716 of the second end band 714. The lugs 712 arranged in the first end band 708 are captured between a first stop collar 720 and a second stop collar 740. Specifically, the lugs 712 extend into a gap 760 between the first stop collar 720 and the second stop collar 740. Also, in the event the second end band 714 includes lugs 718, the lugs are captured between a third stop collar 730 and a fourth stop collar 750. Again, the lugs 718 extend into a gap 770 between the third stop collar 730 and the fourth stop collar 750. In the even the second end band 714 does not include lugs 718, the second end band 714 could be arranged over a single stop collar (e.g., stop collar 440 shown in FIG. 4A).

To make the centralizer assembly 700 shown in FIG. 7, the first stop collar 720 and the third stop collar 730 are arranged on a casing section 702. The first stop collar 720 and the third stop collar 730 may be secured to the casing section 702 using set screws (not shown). Thereafter, the centralizer 704 can be arranged over the first stop collar 720 and the third stop collar 730. With the centralizer 704 positioned over the first stop collar 720 and the third stop collar 730, the lugs 712 and 718 can be arranged in the slots 710 and 716 of the first end band 708 and the second end band 714, respectively. In various embodiments, the lugs 712 could be arranged in the slots 710 in the first end band 708 before the centralizer 704 is positioned over the first stop collar 720 and the third stop collar 730. In such embodiments, the lugs 718 can be arranged in the slots 716 of the second end band 714 after the centralizer 704 is arranged over the first stop collar 720 and the third stop collar 730. After the lugs 712 and 718 are arranged in the slots 710 and 716, respectively, the second stop collar 740 and the fourth stop collar 750 can be arranged on the casing section 702. The second stop collar 740 and the fourth stop collar 750 can then be secured with set screws (not shown).

Referring again to FIGS. 5C and 5D, the length of the circumferential groove 504 along the longitudinal axis may vary in different embodiments. In certain embodiments, the length of the circumferential groove 504 may be only slightly larger than the length of the inner portion 534 of the lug 530 engaged in the circumferential groove 504 to ensure that the lugs 530 and the end band 520 can rotate about the stop collar 502. In such embodiments, the end band 520 practically would not slide relative to the stop collar 502 along the longitudinal axis. In various other embodiments, the length of the circumferential groove 504 may be significantly larger than the length of the inner portion 534 of the lug 503 to permit sliding motion of the end band 520 relative to the stop collar 502.

Figure 8:
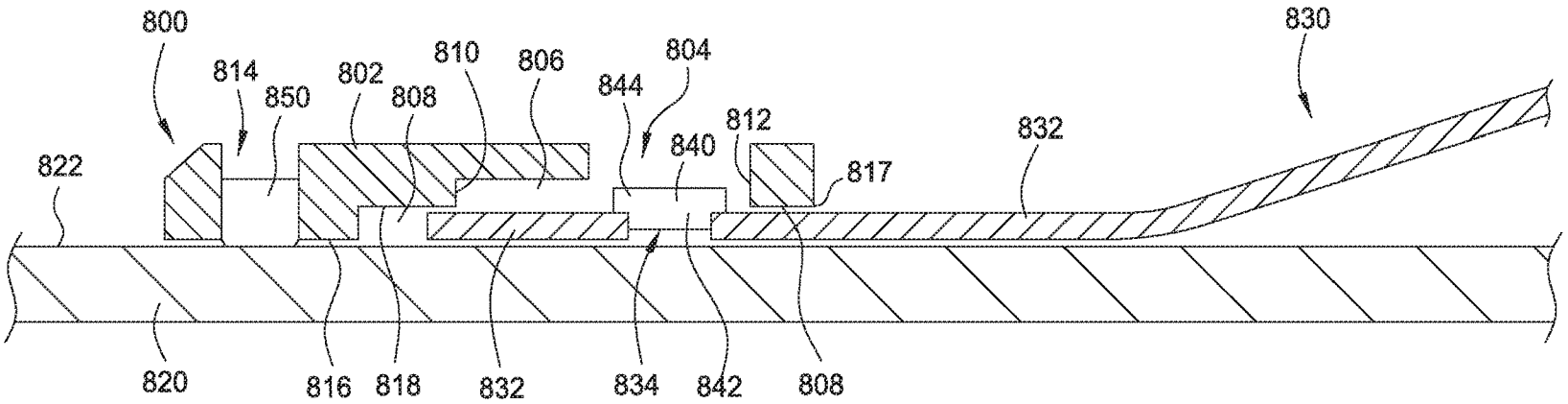
FIG. 8 is a cross-sectional side view of a centralizer assembly according to at least one embodiment.

FIG. 8 is a cross-sectional side view of an a centralizer assembly 800 according to at least one embodiment in which a stop collar 802 covers at least a portion of an end band 832 of a centralizer 800. The stop collar 802 is arranged on a casing section 820 and secured with set screws 850 inserted through threaded holes 814 in the stop collar 802. The stop collar 802 includes an interior surface 816, and a first inward-facing circumferential groove 808 extending into the interior surface 816. The first inward-facing circumferential groove 808 accommodates the end band 832 of the centralizer 800. Specifically, at least a portion of the end band 832 is arranged along an exterior surface 822 of the casing section 820 in the first inward-facing circumferential groove 808. The end band 832 can translate along the exterior surface 822 of the casing section 820 within the first inward-facing circumferential groove 808.

The stop collar 802 also includes a second inward-facing circumferential groove 806 extending from an interior surface 818 of the first inward-facing circumferential groove 808. The second inward-facing circumferential groove 806 accommodates a lug 840 attached to the end band 832. The lug 840 includes an inner portion 842 that can be welded or otherwise affixed in a slot 834 in the end band 832. The lug 840 includes an outer portion 844 that extends into the second inward-facing circumferential groove 806. The outer portion 844 of the lug 840 can contact walls 810 and 812, which limit movement of the lug 840 in the second inward-facing circumferential groove 806. As a result, movement of the end band 832 along the exterior surface 822 of the casing section 820 in the first inward-facing circumferential groove 808 is similarly limited.

To assemble the centralizer assembly, the centralizer 830 (e.g., the centralizer 200 illustrated in FIG. 3A) is placed over the casing section 820. For example, the centralizer 830 can be placed over an end of the casing section 820 and translated along the casing section 820. A stop collar 820 can be placed over the casing section 820 and moved into a desired position. Set screws 850 can be tightened against the exterior surface 822 of the casing section 820 to affix the stop collar 802 in place relative to the casing section 820. Thereafter, the centralizer 830 is moved to insert the end band 832 into the first inward-facing circumferential groove 808 through an opening 817 in the stop collar 802.

The stop collar 802 includes at least one aperture 804 therethrough, wherein the aperture 804 passes through the second inward-facing circumferential groove 806. After the end band 832 is moved into the first inward-facing circumferential groove 808, the end band 832 can be rotated about the casing section 820 to align a slot 834 in the end band 832 with the aperture 804. A lug 840 can be inserted into the slot 834 in the end band 832 through the aperture 804. Thereafter, the lug 840 can be affixed in the end band 832 (e.g., through welding). The end band 832 can then be rotated about the casing section 820 to align additional slots 834 with the aperture 804 until all, most, or some of the slots 834 have lugs 840 affixed therein. After the centralizer 830 is secured in the stop collar 802 with the lugs 840, an end band 802 can be arranged at an opposite end of the centralizer 830 in a similar manner.

In various embodiments, the centralizer assembly 800 can be assembled in a different order from that described above. For example, in one embodiment, the end band 832 can be inserted into the first inward-facing circumferential groove 808 of the stop collar 802 before the centralizer 830 and the stop collar 802 are arranged over the casing section 820.

While the foregoing is directed to embodiments of the present invention, other and further embodiments of the invention may be devised without departing from the basic scope thereof, and the scope thereof is determined by the claims that follow.

The invention claimed is:

1. A centralizer assembly for a wellbore, the centralizer comprising:

a first stop collar having a first circumferential groove arranged on an exterior surface of the first stop collar;

a second stop collar spaced apart from the first stop collar; and a centralizer that includes:

a first end band arranged around the first stop collar, wherein the first end band has an outer diameter greater than an outer diameter of the first stop collar, wherein the first end band can slide relative to the first stop collar, and wherein the first end band includes a first lug that extends into the first circumferential groove;

a second end band arranged around the second stop collar, wherein the second end band can slide relative to the second stop collar; and a plurality of centralizer bow springs arranged between the first end band and the second end band.

2. The centralizer assembly of claim 1, wherein an interference between the first lug and ends of the first circumferential groove limits travel of the first end band along the first stop collar.

3. The centralizer assembly of claim 1, wherein the second stop collar includes a second circumferential groove arranged on an exterior surface of the second stop collar, and wherein the second end band includes a second lug that extends into the second circumferential groove.

4. The centralizer assembly of claim 3, wherein an interference between the second lug and ends of the second circumferential groove limits travel of the second end band along the second stop collar.

5. The centralizer assembly of claim 3, further comprising an a second aperture in the second circumferential groove.

6. The centralizer assembly of claim 5, wherein the second lug includes dimensions smaller than the second aperture in the first stop collar such that the first lug can pass through the second aperture.

7. The centralizer assembly of claim 1, further comprising an a first aperture in the first circumferential groove.

8. The centralizer assembly of claim 7, wherein the first lug includes dimensions smaller than the first aperture in the first stop collar such that the first lug can pass through the first aperture.

9. A centralizer assembly for a wellbore, the centralizer comprising:

a first stop collar having a first circumferential groove arranged on an exterior surface of the first stop collar, wherein the first circumferential groove extends around a circumference of the first stop collar, and wherein the first stop collar includes a first aperture in the first circumferential groove;

a second stop collar spaced apart from the first stop collar; and a centralizer that includes:

a first end band arranged around the first stop collar, wherein the first end band can slide relative to the first stop collar, wherein the first end band includes a first slot therethrough;

a first lug arranged relative to the first end band, wherein an outer portion of the first lug is arranged in the first slot, wherein an inner portion of the first lug extends into the first circumferential groove, and wherein the first lug includes dimensions smaller than the first aperture in the first stop collar such that the first lug can pass through the first aperture to arrange the outer portion of the first lug in the first slot;

a second end band arranged around the second stop collar, wherein the second end band can slide relative to the second stop collar; and a plurality of centralizer bow springs arranged between the first end band and the second end band.

10. The centralizer assembly of claim 9, wherein an interference between the first lug and ends of the first circumferential groove limits travel of the first end band along the first stop collar.

11. The centralizer assembly of claim 9, wherein the second stop collar includes a second circumferential groove arranged on an exterior surface of the second stop collar, wherein the second circumferential groove extends around a circumference of the second stop collar, and wherein the second stop collar includes a second aperture in the second circumferential groove;

wherein the second end band includes a second slot therethrough; and further comprising a second lug arranged relative to the second end band, wherein an outer portion of the second lug is arranged in the second slot, wherein an inner portion of the second lug extends into the second circumferential groove, and wherein the second lug includes dimensions smaller than the second aperture in the second stop collar such that the second lug can pass through the second aperture to arrange the outer portion of the second lug in the second slot.

12. The centralizer assembly of claim 11, wherein an interference between the second lug and ends of the second circumferential groove limits travel of the second end band along the second stop collar.

13. A centralizer assembly for a wellbore, the centralizer comprising:

a first stop collar, wherein the first stop collar includes a first circumferential groove arranged on an exterior surface of the first stop collar, the first circumferential groove having a first sidewall, a second sidewall, and a bottom surface;

a second stop collar spaced apart from the first stop collar; and a centralizer that includes:

a first end band arranged around the first stop collar, wherein the first end band can slide relative to the first stop collar, wherein the first end band includes a first lug that extends into the first circumferential groove;

a second end band arranged around the second stop collar, wherein the second end band can slide relative to the second stop collar; and a plurality of centralizer bow springs arranged between the first end band and the second end band.

14. The centralizer assembly of claim 13, wherein an interference between the first lug and ends of the first circumferential groove limits travel of the first end band along the first stop collar.

15. The centralizer assembly of claim 13, wherein the second stop collar includes a second circumferential groove having a first sidewall, a second sidewall, and a bottom surface, wherein the second circumferential groove is arranged on an exterior surface of the second stop collar, and wherein the second end band includes a second lug that extends into the second circumferential groove.

16. The centralizer assembly of claim 15, wherein an interference between the second lug and ends of the second circumferential groove limits travel of the second end band along the second stop collar.

17. The centralizer assembly of claim 15, further comprising an a second aperture in the second circumferential groove.

18. The centralizer assembly of claim 17, wherein the second lug includes dimensions smaller than the second aperture in the first stop collar such that the first lug can pass through the second aperture.

19. The centralizer assembly of claim 13, wherein the first stop collar includes a first aperture in the first circumferential groove.

20. The centralizer assembly of claim 19, wherein the first lug includes dimensions smaller than the first aperture in the first stop collar such that the first lug can pass through the first aperture.

* * * * *